US005437100A

United States Patent [19]

Oberloier et al.

[11] Patent Number: 5,437,100

[45] Date of Patent: Aug. 1, 1995

[54] ADJUSTABLE CLAY CUTTER

[76] Inventors: Robert J. Oberloier; Nicole A. Oberloier, both of 5571 Quilley Ave., Rogers, Minn. 55374

[21] Appl. No.: 294,318

[22] Filed: Aug. 4, 1994

[51] Int. Cl.[6] ..... B26B 27/00

[52] U.S. Cl. ..... 30/116; 30/294

[58] Field of Search ..... 30/115, 116, 117, 293, 30/294

[56] References Cited

U.S. PATENT DOCUMENTS

| | | | |
|---|---|---|---|
| 137,064 | 3/1873 | Fancher . | |
| 1,939,283 | 12/1933 | Shailer . | |
| 1,998,493 | 4/1935 | Vettier . | |
| 2,093,867 | 9/1937 | Fitzgerald . | |
| 2,283,569 | 5/1942 | Pedersen . | |
| 2,475,824 | 7/1949 | Devine . | |
| 2,825,131 | 3/1958 | Cole . | |
| 3,277,754 | 10/1966 | Lopez | 30/116 X |
| 3,277,754 | 10/1966 | Lopez . | |
| 3,831,279 | 8/1974 | Burns | 30/294 X |
| 4,425,706 | 1/1984 | Southworth et al. . | |
| 5,153,993 | 10/1992 | Whisnant . | |

FOREIGN PATENT DOCUMENTS

| | | | |
|---|---|---|---|
| 472594 | 4/1951 | Canada | 30/116 |

*Primary Examiner*—Douglas D. Watts
*Attorney, Agent, or Firm*—Haugen and Nikolai

[57] ABSTRACT

An economical adjustable clay cutter for repeatably cutting equal segments of clay is disclosed. The device includes an arbor, cutting means, guide means, locking means, a handle and measuring means. The adjustable clay cutter is designed to reduce the amount of stress and strain to the user's wrist during repetitive use.

9 Claims, 2 Drawing Sheets

ADJUSTABLE CLAY CUTTER

FIELD OF THE INVENTION

The present invention relates generally to a cutting tool. More particularly it relates to an economical, simple, adjustable, cutting tool for repeatedly cutting blocks of clay into uniform desired segments. The cutting tool of the present invention decreases strain on the user's wrist. The decreased strain is due to a reduction in torque to the cutting tool when a force is being applied by the cutting wire against a block of clay.

BACKGROUND OF THE INVENTION

A typical economic potter tool for cutting clay consists of a wire, with rings attached to both ends of the wire. The user slides one of the rings over a finger of each hand, thereby holding the wire. Holding the wire in this manner allows the user to pull or push the wire through a block of clay, cutting the block into segments. Cutting the clay in this manner makes it difficult to cut the segment into equal widths throughout. Also, it is difficult to cut the block into consistent, uniform segments. Further, repetitious use of the cutting wire and rings creates a strain on the user's wrists.

Other tools for cutting a desired material provide for a means to cut a plurality of uniform consistent segments from a larger block. For example, Whisnant U.S. Pat. No. 5,153,993 discloses a clay cutter with a plurality of cutting wires that are held in position, an equal distance from each other and attached to an arbor. By applying an even, direct, downward force to the arbor the Whisnant clay cutter simultaneously cuts a plurality of segments of clay. The Whisnant cutter does not have a handle and requires two hands to operate. Further, the required direct force to the arbor creates a strain on the user's wrists. Therefore, a need exists for a clay cutter that requires the use of only one hand to cut a block of clay into equal predetermined segments with reduced strain to the user's wrist.

The Devine U.S. Pat. No. 2,475,824 discloses a food slicer with a handle integrally connected to the arbor. The arbor has a guide that is slidably attached between the arbor. The guide may be adjusted, however, a bolt must be rotated to slidably move the guide. The distance the guide moves is proportional to the number of revolutions of the bolt. Moving the guide in this manner requires a greater amount of time, reducing the efficiency of repetitious cuts of varying width's. Therefore, a need exists for a clay cutter having a quickly positionable guide.

The present known cutting tools, that have arbors with handles, all have the handle integral with the arbor. See for example Devine U.S. Pat. No. 2,475,824, and Fitzgerald U.S. Pat. No. 1,939,283. When employing a cutting tool of this type to cut a desired material, the user applies a linear force to the handle in the direction the user wants the cutting wire to move. When the cutting wire contacts a surface, a torque results in the direction opposite the linear force. The resultant torque causes the cutting tool to rotate away from the surface. The position on the handle where the linear force is being applied becomes the pivot point of rotation. To keep the cutting tool from rotating around the pivot point, the user's wrist must supply an equal but opposite torque. The resultant torque is reduced by decreasing the distance between the pivot point and the point where the cutting wire contacts the surface. This reduction in resulting torque decreases the users risks of carpal tunnel damage resulting from the repetitive cutting of clay segments. Therefore, a need exists for a cutting tool that reduces the amount of torque required to keep the cutting tool from rotating around the pivot point.

The present invention overcomes these disadvantages and meets the present needs by providing a cutting tool that only requires one hand for proper use. The invention also has a handle attached such that the torque against the wrist is reduced. The present clay cutter also has a guide means that can be repositioned quickly and efficiently without the need to manipulate a threaded adjustment.

SUMMARY OF THE INVENTION

The purpose of the present invention is to provide an adjustable clay cutter that only requires one hand to operate, with a reduced torque against the wrist. It is also a purpose of the present invention to provide an adjustable guide means that can be positioned quickly and efficiently, without the need to manually manipulate a locking mechanism. The present invention has a cutting wire, an arbor, a handle, a guide means, an automatic locking means and a measuring means.

The arbor is designed in a U-shape having ends that securely hold the cutting wire therebetween. The guide means slidably engages between the arbor and can be locked in various desired positions. The user determines the desired position using the calibrated scale that is attached to the guide means. The user can slide the guide means along the arbor and then the locking means automatically retains the guide means in this position. A handle is secured to the guide means at an angle relative to the cutting means, thereby reducing the amount of torque applied to the wrist as compared to the torque applied to the wrist when the handle is integrally related to the arbor.

It is accordingly a principal object of the present invention to provide an economical adjustable clay cutter that reduces the amount of torque on the wrist.

Another object of the present invention is to provide an adjustable clay cutter that may be operated easily and efficiently with one hand.

A further object of the present invention is to provide an economical adjustable clay cutter that can cut repetitively uniform consistent segments to a desired pre-set width.

Yet another object of the present invention is to provide an adjustable clay cutter with a means to automatically lock the guide means.

These and other objects of the present invention will be readily apparent to those skilled in the art from a review of the following detailed description of the preferred embodiment in conjunction with the accompanying drawings and claims.

DETAILED DESCRIPTION OF THE PREFERRED EMBODIMENT

Figure 1:
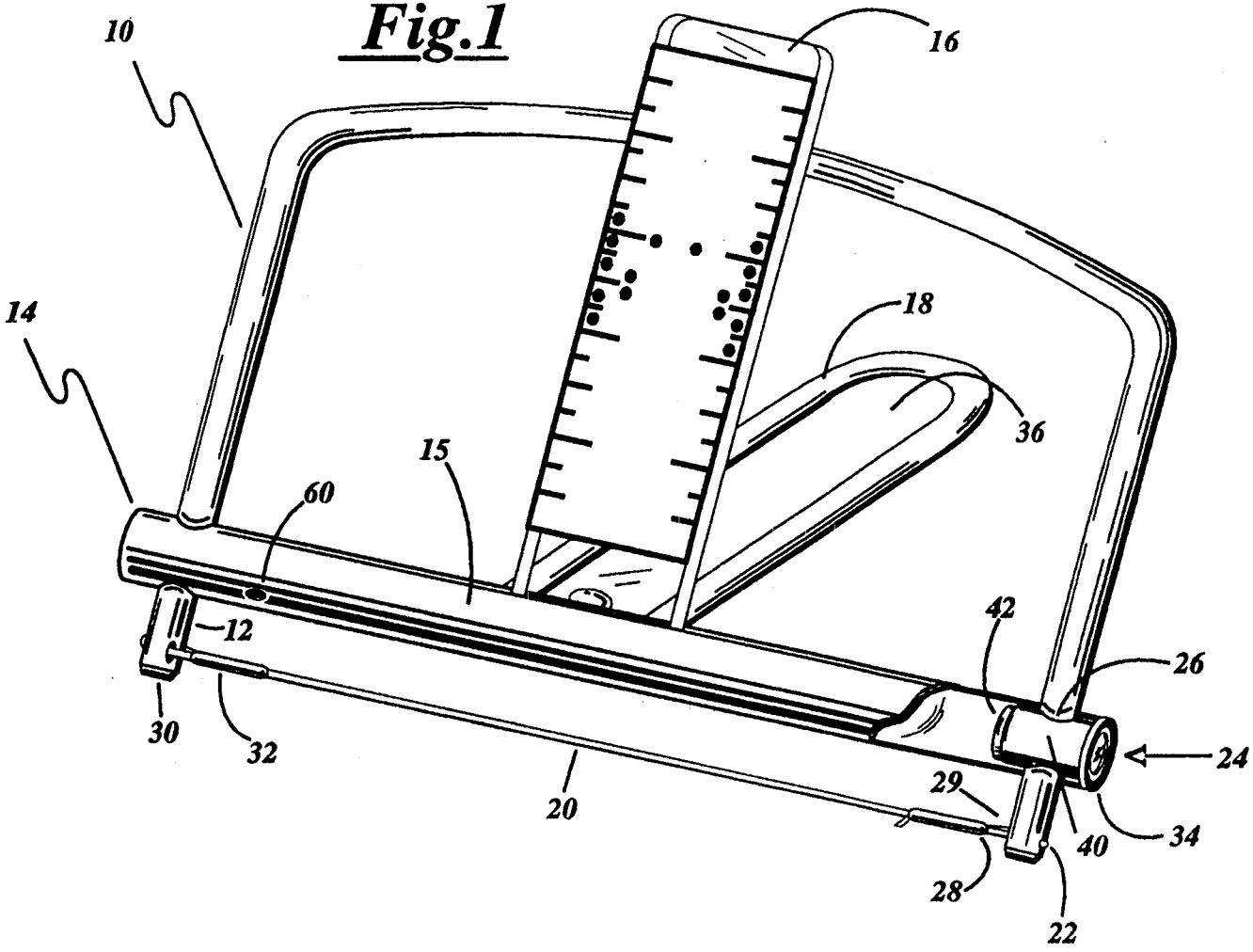
FIG. 1 is a partial sectional perspective view of the adjustable clay cutter showing the locking mechanism engaged.
Figure 4:
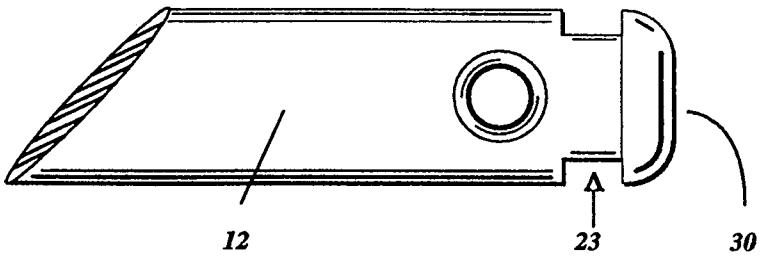
FIG. 4 is an exploded side elevational view, broken away, of the alternate preferred embodiment of the arbor end.

Referring first to FIG. 1, the adjustable clay cutter 10 is shown generally having an arbor 12, a guide means 14, a measuring means 16, a handle 18, a cutting means 20, and a locking means 24. The arbor is u-shaped with ends 30 having bores 22 extending through the arbor 12 near the ends 30. Each end 28 of the cutting means 20 extends through the bores 22 and are affixed relative to the ends 30 with a clamping means 32. In the alternate preferred embodiment of the arbor end shown in FIG. 4, a slot or groove 23 is formed at the ends 30 of the arbor 12 and extends around the circumference of the arbor 12. Each end 28 of the cutting means 20 may be secured to the cutting means with the clamping means 32 thereby forming a loop 29. The loop 29, is slid into the groove 23 allowing the cutting means 20 to be easily positioned and removed. The cutting means is selected from a group consisting of a wire, a cable, a cord, or a thin strip of rigid material. However, cable is preferred because of its tensile strength and resilience.

The guide means 14 consists of a fence 15 having bores 26 extending through the sides allowing the arbor 12 to slidably engage through the bores 26. The fence 15 also has a second set of bores 34 extending into the ends of the fence, to allow the locking means 24 to be positioned within the fence 15 (see FIGS. 1 and 2). The fence may also be constructed from hollow tubing. A bore 60 extends through the fence 15 and are used in positioning the locking means 24 within the fence 15. The fence 15 is preferably cylindrical to allow the fence to easily slide over the material being cut. Of course, the fence may be constructed of other geometric shapes. The fence 15 may be slid at varying distances, parallel to the cutting means 20, to allow the user to predetermine the width of the cut segment. The fence 15 also has a handle 18 and a measuring means 16 extending therefrom.

Figure 2:
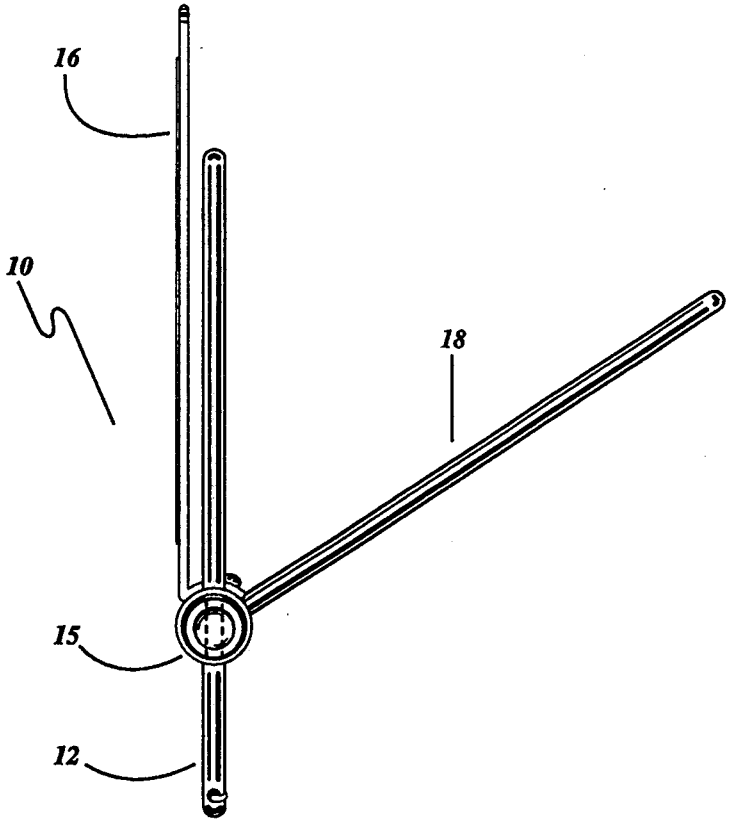
FIG. 2 is a side elevational view of the adjustable clay cutter of the type shown in FIG. 1.

The handle 18 forms an elongated u-shape with a hollow center portion 36 to reduce the overall weight of the adjustable clay cutter 10. The handle 18 extends from the fence 15 in a direction away from the cutting means 20. Referring to FIG. 2 the handle may be positioned at an angle at least 90 degrees away from the cutting means 20 and less than 180 degrees, but 130 degrees is the preferred angle.

The handle 18 is positioned at an angle relative to the cutting means 20 to allow the clay cutter 10 to be easily pushed or pulled through the clay. When the cutting wire 20 contacts a surface, a torque results in the direction opposite the linear force. The resultant torque causes the cutting tool 10 to rotate away from the surface. The position on the handle 18 where the linear force is being applied becomes the pivot point of rotation. The resultant torque is reduced by decreasing the distance between the pivot point and the point where the cutting wire 20 contacts the surface. Also, positioning the handle 18 at an angle relative to the cutting wire 20 further reduces the distance between the cutting wire 20 and the pivot point. By decreasing the distance between the pivot point and the point where the cutting wire contacts the surface, the magnitude of the resulting torque to the user's wrist is reduced. This reduction in resulting torque decreases the users risks of carpal tunnel damage resulting from the repetitive cutting of clay segments. The handle 18 also extends from the guide means 15, rather than the arbor 12, to further reduce the distance between the pivot point and the cutting wire 20.

Also extending in a direction opposite the cutting means 20 and parallel to the arbor 12 is a measuring means 16. The measuring means is centered on the fence 15 equally between the two ends 30 of the arbor 12. The measuring means 16 allows the block of clay to be cut to a pre-determined width with greater precision. When cutting a block of clay the corners may be rounded. Measuring the width at these rounded ends, leads to a greater uncertainty in the resulting cut width. By predetermining the width of the cut segment from middle of the block rather than the rounded sides, greater precision of the cut width is obtained.

Figure 3:
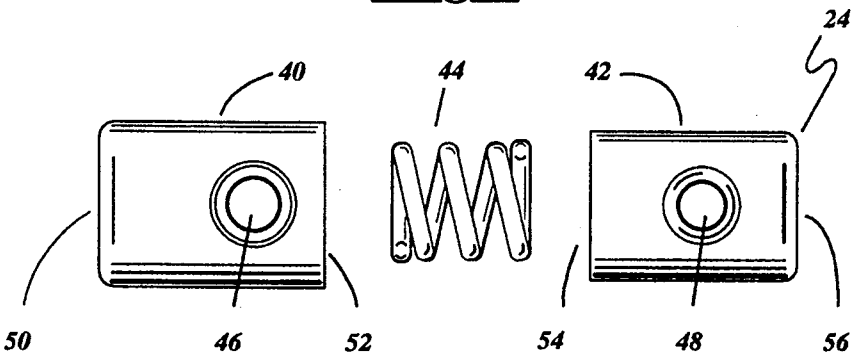
FIG. 3 is an exploded perspective view of the preferred locking mechanism of the type shown in FIG. 1, aligned but separated.

Referring next to FIG. 3 the locking means 24 is generally shown having an outer tube 40, an inner tube 42, and a spring 44. The locking means 24 is a spring loaded member that applies tension to the arbor 12. The outer tube 40 has a closed end 50 and an open end 52. The outer tube 40 also has an offset bore 46, offset closer to the open end 52, and extending through the tube. The inner tube has an outside diameter slightly smaller than the inner diameter of the open end 52 of the outer tube 40. The inner tube has an open end 56 and a closed end 54. The inner tube 42 also has a bore 48 that is offset from the center of the inner tube 42, towards the closed end 54. Of course, the inner tube could be a solid cylinder having a bore 48 extending through the tube, that is offset from the center of the inner tube 42. A spring 44 is aligned inside the outer tube 40. The inner tube 42 is slid into the outer tube 40, compressing the spring 44, so that the bores 46 and 48 are aligned with respect to each other.

The locking means 24 is placed in each bore 34 extending into the ends of the fence 15, so that the bores 26, 46, and 48, are all aligned relative to each other. A pin not shown in the figures may be inserted into the bore 60. The pin 60 acts as a stopper, thereby allowing the locking means to be compressed inside the fence 15 such that the bores 26, 46, and 48 are all aligned.

Prior to attaching the cutting means 20, the ends 30 of the arbor 12 are then slid through the bores 26, 46, and 48. The spring 44 applies a force to the closed end 54 of the inner tube 42, and the closed end 50 of the outer tube 40. This force causes the surface surrounding the bores 46 and 48 to engage with the arbor 12 holding the guide means 14 in the desired locked position. The guide means 14 may be slid along the arbor 12 with a force overcoming the spring 44 force, thereby allowing the fence 15 to be moved to various positions along the arbor 12. Other devices that may be used for locking the fence 15 in position relative to the arbor 12, include a clamp, a fastener, bolts, notches and indents; however, the above described locking means is preferred.

Having described the constructional features of the adjustable clay cutter 10, the mode of use will now be discussed. By aligning the measuring means 16 with the arbor 10, the user slides the guide means 14 along the arbor 10 to the desired width of cut. The operator then positions the block of clay centered between the two arbor ends 30. The guide means 14 is positioned flush with the surface of the block of clay. The adjustable clay cutter 10 may then be pushed or pulled through the clay, cutting the block in a segment having a width equal to the preset width of the clay cutter 10. These steps may be repeated, producing similar width segments of clay.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed:

1. A cutting device for slicing a desired material to a predetermined size comprising:

(a) a u-shaped arbor;

(b) a cutting means secured to said arbor for cutting a desired material;

(c) a guide means for guiding said cutting means through said desired material having a first set of bores extending through said guide means thereby allowing said arbor to slide through said guide means, and a second set of bores extending partially through said guide means at an angle relative to said first set of bores;

(d) a handle extending from said second set of bores of said guide means, in a direction away from said cutting means, for pushing or pulling said cutting means through the desired material; and (e) a locking means for locking said guide means in a fixed position.

2. A device as recited in claim 1 wherein said locking means comprises an inner tube having a length and width dimension with a bore extending through said width and offset from a center of said length; an outer tube with a length, a width, an open end and a closed end having a bore extending through the width of said outer tube and positioned closer to said open end; and a spring, wherein said inner tube slides through said open end of said outer tube with said spring placed inside said outer tube such that a force against said spring is required to push said inner tube into said outer tube; said bores of said inner and outer tubes align with each other when said inner tube is pushed into said outer tube.

3. A device as recited in claim 1 wherein said cutting means is selected from a group consisting of a wire, a cord, a cable, and a thin strip of rigid material.

4. A device as recited in claim 1 further including a measuring means attached to said guide means, wherein said measuring means may be calibrated such that a width of a cut segment is known before slicing a desired material to a predetermined size.

5. A device for cutting clay to a predetermined size having a volume that is known at the time of cutting the clay comprising:

(a) a u-shaped arbor;

(b) a cutting wire secured to said arbor for cutting a desired material;

(c) an adjustable fence for guiding said cutting means through said desired material having a first set of bores extending through said guide means thereby allowing said arbor to slide through said fence, and a second set of bores extending partially through said fence at an angle relative to said first set of bores;

(d) a handle extending from said fence away from said cutting wire for pushing or pulling said cutting means through said desired material;

(e) a locking mechanism; and (f) a measuring means attached to said fence, wherein said means may be calibrated such that a width of a cut segment is known before slicing a desired material to a predetermined size.

6. A device as recited in claim 5 wherein said locking means comprises an inner tube having a length and width dimension with a bore extending through said width and offset from a center of said length; an outer tube with a length, a width, an open end and a closed end having a bore extending through the width of said outer tube and positioned closer to said open end; and a spring, wherein said inner tube slides through said open end of said outer tube with said spring placed inside said outer tube such that a force against said spring is required to push said inner tube into said outer tube; said bores of said inner and outer tubes align with each other when said inner tube is pushed into said outer tube.

7. A device as recited in claim 5 wherein said cutting means is selected from a group consisting of a wire, a cord, a cable, and a thin strip of rigid material.

8. A device as recited in claim 5 wherein said handle is positioned at an angle between 90 and 180 degrees away from said cutting wire.

9. A cutting device for cutting a desired material to a pre-determined size and known volume comprising:

(a) a u-shaped arbor:

(b) a cutting means secured to said arbor for cutting a desired material;

(c) an adjustable guide means for guiding said cutting means through said desired material, said adjustable guide means ~~having bores extending there~~through, said arbor sliding through said bores;

(d) handle means for pushing and pulling said cutting means through said desired material, said handle means extending from said guide means in a direction away from said cutting means; and (e) locking means for locking said guide means in a fixed position; said locking means comprising an inner tube, having a length and width dimension, with a bore extending through said width dimension, and offset from a center of said length dimension; an outer tube with a length and width dimension, an open end and a closed end, and a bore extending through the width dimension of said outer tube positioned proximate said open end; and a spring disposed in said outer tube proximate said closed end, said inner tube being inserted through said open end of said outer tube against said spring such that a force against said spring is required to push said inner tube into said outer tube; said bores of said inner and outer tubes becoming aligned with each other when said inner tube is pushed into said outer tube against the force of said spring.

* * * * *